US011027886B2

(12) United States Patent
Malin et al.

(10) Patent No.: US 11,027,886 B2
(45) Date of Patent: Jun. 8, 2021

(54) DUAL HANDLE CONTAINER

(71) Applicant: Arkema Inc., King of Prussia, PA (US)

(72) Inventors: Kenneth R. Malin, Woolwich Township, NJ (US); Andrejs R. Lizins, Honey Brook, PA (US)

(73) Assignee: Arkema Inc., King of Prussia, PA (US)

( * ) Notice: Subject to any disclaimer, the term of this patent is extended or adjusted under 35 U.S.C. 154(b) by 88 days.

(21) Appl. No.: 16/088,457

(22) PCT Filed: Mar. 27, 2017

(86) PCT No.: PCT/US2017/024247
§ 371 (c)(1),
(2) Date: Sep. 26, 2018

(87) PCT Pub. No.: WO2017/172579
PCT Pub. Date: Oct. 5, 2017

(65) Prior Publication Data

US 2019/0112106 A1 Apr. 18, 2019

Related U.S. Application Data

(60) Provisional application No. 62/315,101, filed on Mar. 30, 2016.

(51) Int. Cl.
*B65D 25/28* (2006.01)
*B65D 1/42* (2006.01)
(Continued)

(52) U.S. Cl.
CPC ..... *B65D 25/2894* (2013.01); *B65D 1/0276* (2013.01); *B65D 1/20* (2013.01);
(Continued)

(58) Field of Classification Search
CPC .. B65D 25/2894; B65D 21/0231; B65D 1/20; B65D 1/42; B65D 25/2897; B65D 25/42;
(Continued)

(56) References Cited

U.S. PATENT DOCUMENTS 3,696,958 A * 10/1972 Lee ..... B65D 51/165 215/261
4,541,529 A * 9/1985 Hestehave ..... B65D 21/023 16/436

(Continued)

OTHER PUBLICATIONS

Container 1; Container 2; Container 3, Container 4 pp. 1-4.

*Primary Examiner* — Shawn M Braden
(74) *Attorney, Agent, or Firm* — Lynn B. Morreale

(57) ABSTRACT

A plastic container configured to store and/or transport liquids, including chemicals such as organic peroxide, includes a top portion, a base portion, and a sidewall that extends between the top portion and the base portion. The top portion has a vent spout and a main spout. The top portion also has a front surface portion having a slanted face and a lip that extends radially from the main spout away from the slanted face. Additionally, the top portion has an integrated handle that defines a maximum handle length that is approximately half of the maximum container length. The base portion has an interior surface and an exterior surface. The exterior surface defines a handle recess.

20 Claims, 5 Drawing Sheets

(51) Int. Cl.

| | |
|---|---|
| ***B65D 1/20*** | (2006.01) |
| ***B65D 1/02*** | (2006.01) |
| ***B65D 25/22*** | (2006.01) |
| ***B65D 25/42*** | (2006.01) |

(52) U.S. Cl.
CPC ..... *B65D 1/42* (2013.01); *B65D 25/22* (2013.01); *B65D 25/2897* (2013.01); *B65D 25/42* (2013.01); *B65D 2205/02* (2013.01)

(58) Field of Classification Search
CPC .... B65D 2205/02; B65D 25/22; B65D 25/28; B65D 1/00; B65D 1/0276
See application file for complete search history.

(56) References Cited

U.S. PATENT DOCUMENTS

| | | | | |
|---|---|---|---|---|
| 4,811,870 | A * | 3/1989 | Bianco | B65D 25/2894 222/461 |
| 4,923,098 | A | 5/1990 | Schoonover et al. | |
| 5,265,743 | A | 11/1993 | Frohn | |
| 6,029,858 | A * | 2/2000 | Srokose | B65D 1/18 222/143 |
| 2007/0023459 | A1 | 2/2007 | Harder et al. | |
| 2008/0073317 | A1* | 3/2008 | Dygert | B65D 77/0426 215/397 |
| 2018/0305079 | A1* | 10/2018 | Tietze | B65D 88/748 |

* cited by examiner

DUAL HANDLE CONTAINER

This application is a national stage application under 35 U.S.C. § 371 of PCT/US2017/024247 filed Mar. 27, 2017, which claims benefit to U.S. patent application Ser. No. 62/315,101, filed Mar. 30.2016.

TECHNICAL FIELD

This disclosure relates generally to plastic containers configured to store and/or transport liquids, including chemicals such as organic peroxides.

BACKGROUND

Containers used for storing and transporting chemicals, such as organic peroxides, have strict performance requirements in order to ensure safety during transportation due to the volatile nature of the contents of those containers. While known product configurations satisfy those requirements by meeting certain drop test ratings, there are certain limitations to the features included in those designs.

SUMMARY

While known configurations are able to meet industry required drop test ratings, those containers provide inadequate gripping structures and are also difficult to fully drain. The limitations of known configurations present safety concerns both in relation to lifting the container to pour and fully draining the container at the end of its use. Some containers are not readily manipulated by a user. In addition, some containers are not readily stackable or storable in multiple stacking configurations. The inventors of the present application provide a container that addresses a need for better containers for chemicals, which is particularly suitable for organic peroxides, but which may be used to store and/or transport a variety of chemicals. The container of the present disclosure provides a container that is configured to provide enhanced emptying ability. This enhanced emptying ability is achieved through the location and design of the main pouring spout, the configuration of the neck and shoulders of the front top of the container, and the contours of the bottom of the container, the combination of which minimizes the need for the user to pierce the bottom of the container multiple times in order to achieve complete drainage. In one aspect, the shoulders (or front surface portion) of the container are sloped in the downward direction. The container also includes a top in-line elongated handle portion. The container itself may have a square, or substantially square configuration allowing for stackability and providing for maximum usage of available space on a square shipping pallet. The container may be configured to meet current UN ratings, especially for organic peroxides. The term "square" as used herein means that the container is configured such that the length and width of the bottom surface are substantially equal. The container may comprise HDPE.

According to an aspect of the disclosure, a plastic container configured to store and/or transport liquids, such as organic peroxides, includes a top portion having a vent spout that defines a circular vent recess that has a vent center. The vent spout extends longitudinally along a first axis, the first axis extending through the vent center. The top portion also includes a main spout that defines a circular main recess having a main center. The main spout extends longitudinally along a second axis, the second axis extending through the main center. The main spout has a top end and a bottom end of the main spout, the top end being opposite the bottom end along the second axis such that the bottom end is disposed in a downward direction relative to the top end along the second axis. The top portion also includes a front surface portion having a slanted face that extends in the downward direction and in a forward direction. The forward direction is defined by a line that extends from the first axis to the second axis, perpendicular to the first axis and second axis. The front surface also includes a lip that extends radially from the second axis away from the slanted face in the forward direction. Additionally, the top portion includes an integrated handle that is elongate along the line that extends between the first axis and the second axis. The top panel defines a maximum container length along the line and the handle defines a maximum handle length along the line. The maximum container length is approximately twice the maximum handle length. The container also includes a base portion. The base portion has an interior surface and an exterior surface. The exterior surface defines a handle recess. Additionally, the container includes a sidewall that extends between the top portion and the base portion.

According to another aspect of the disclosure, a plastic container configured to store and/or transport liquid, such as organic peroxide includes a top portion having a vent spout that defines a circular vent recess that has a vent center. The vent spout extends longitudinally along a first axis, the first axis extending through the vent center. The top portion also includes a main spout that defines a circular main recess having a main center. The main spout extends longitudinally along a second axis, the second axis extending through the main center. The main spout has a top end and a bottom end of the main spout, the top end being opposite the bottom end along the second axis such that the bottom end is disposed in a downward direction relative to the top end along the second axis. The top portion also includes a front surface portion having a slanted face that extends in the downward direction and in a forward direction. The forward direction is defined by a line that extends from the first axis to the second axis, perpendicular to the first axis and second axis. The front surface also includes a lip that extends radially from the second axis away from the slanted face in the forward direction. Additionally, the top portion includes an integrated handle that is elongate along the line that extends between the first axis and the second axis. The container also includes a base portion. The base portion has an interior surface and an exterior surface. The exterior surface defines a handle recess. Additionally, the container includes a sidewall that extends between the top portion and the base portion.

According to a third aspect of the disclosure, a plastic container configured to store and/or transport liquid, such as organic peroxide includes a top portion having a vent spout that defines a circular vent recess that has a vent center. The vent spout extends longitudinally along a first axis, the first axis extending through the vent center. The top portion also includes a main spout that defines a circular main recess having a main center. The main spout extends longitudinally along a second axis, the second axis extending through the main center. The main spout has a top end and a bottom end of the main spout, the top end being opposite the bottom end along the second axis such that the bottom end is disposed in a downward direction relative to the top end along the second axis. Additionally, the top portion includes an integrated handle that is elongate along the line that extends between the first axis and the second axis. The top panel defines a maximum container length along the line and the handle defines a maximum handle length along the line. The maximum container length is approximately twice the maximum handle length. The container also includes a base portion. The base portion has an interior surface and an exterior surface. The interior surface is opposite the exterior surface. Additionally, the container includes a sidewall that extends between the top portion and the base portion.

BRIEF DESCRIPTION OF THE DRAWINGS

The foregoing summary, as well as the following detailed description of illustrative embodiments of the dual handle container of the present application, will be better understood when read in conjunction with the appended drawings. For the purposes of illustrating the dual handle container of the present application, there is shown in the drawings illustrative embodiments. It should be understood, however, that the application is not limited to the precise arrangements and instrumentalities shown. In the drawings.

DETAILED DESCRIPTION OF THE ILLUSTRATIVE EMBODIMENTS

Aspects of the disclosure will now be described in detail with reference to the drawings, wherein like reference numbers refer to like elements throughout, unless specified otherwise. Certain terminology is used in the following description for convenience only and is not limiting.

Figure 1:
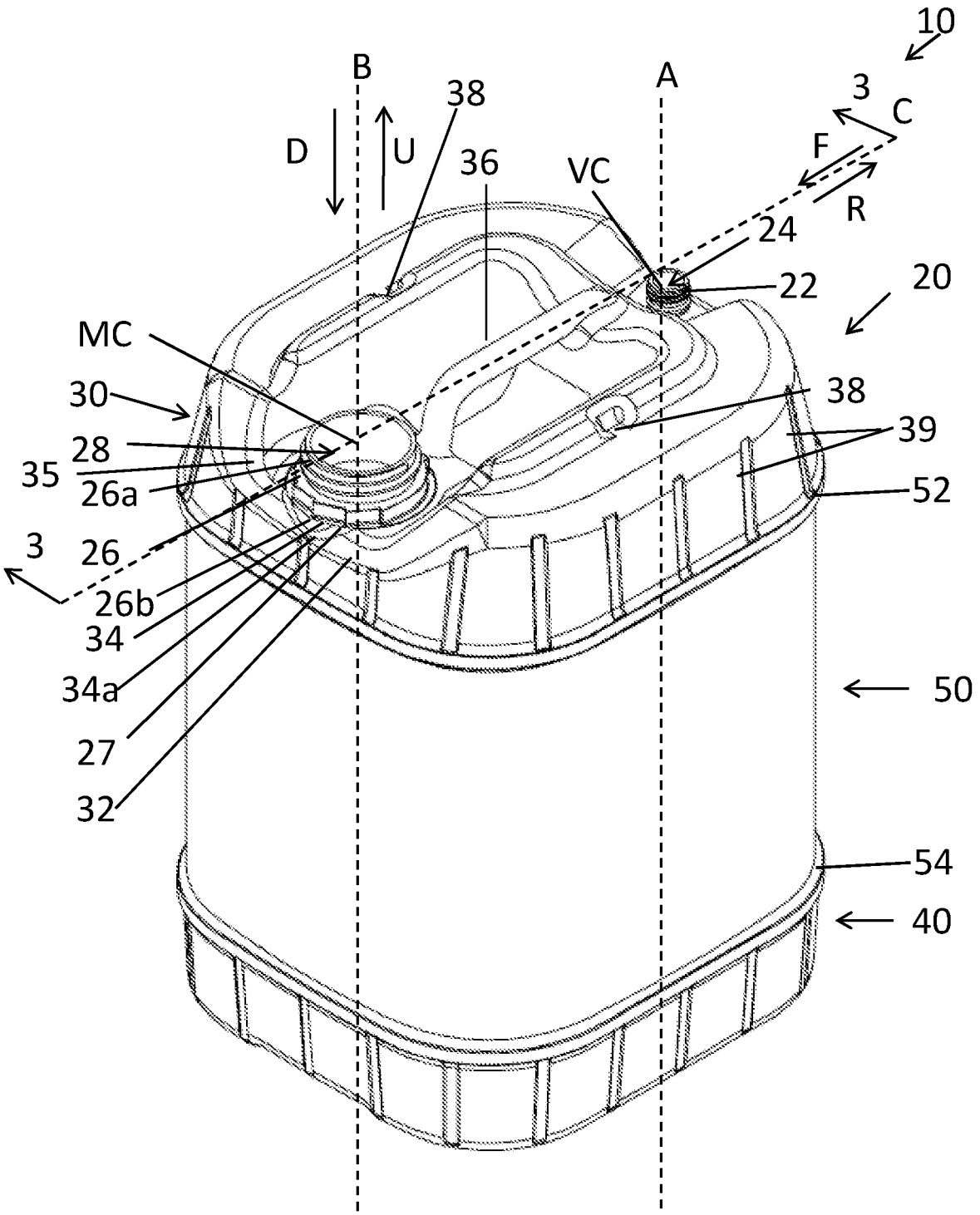
FIG. 1 is a perspective view of a dual handle container.

Referring to FIG. 1, a plastic container 10, such as a tighthead container, is made of high-density polyethylene and is configured to store and/or transport liquid, such as organic peroxide. For example, container 10 may be a five gallon container configured to hold five gallons of organic peroxide. Alternatively, container 10 may be a one gallon container configured to hold one gallon of organic peroxide. Alternatively still, container 10 may be a six or seven gallon container configured to hold six or seven gallons of organic peroxide, respectively. Container 10 may be configured to hold organic peroxide in neat form (i.e., with no solvent). Container 10 may also be configured to hold organic peroxide with organic diluents such as isododecane, mineral oil aliphatic, hydrocarbons, aromatic hydrocarbons, and oxygenated hydrocarbons, such as ethers, epoxides, and esters. Additionally, container 10 may be configured to hold organic peroxide with non-organic diluent such as water.

The container 10 includes a top portion 20, a base portion 40, and a sidewall 50 that extends between the top portion 20 and the base portion 40. The top portion 20 includes a vent spout 22 that defines a circular vent recess 24 having a vent center VC. In some embodiments, vent recess 24 has a diameter of at least 22 millimeters. The vent spout 22 extends longitudinally along a first axis A, the first axis A extending through the vent center VC. The vent spout 22 has an outer surface that defines an attachment mechanism for a vent cap (not shown). In some embodiments, the attachment mechanism on the vent spout may be threads that mate with threads on an internal surface of the vent cap.

The top portion 20 further includes a main spout 26 that defines a circular main recess 28 having a main center MC. In some embodiments, circular main recess 28 has a diameter of no more than 63 millimeters, such as a diameter of 61 millimeters. In other embodiments, circular main recess 28 has a diameter of 70 millimeters. The diameters of vent recess 24 and main recess 28 may be adjusted relative to each other to optimize pourability of the contents of the container 10. The diameters of vent recess 24 and main recess 28 may also be adjusted to optimize drop test ratings.

The main spout 26 extends longitudinally along a second axis B that extends through the main center MC from a top end 26*a* of the main spout 26 to a bottom end 26*b* of the main spout 26. The top end 26*a* is opposite the bottom end 26*b* along the second axis B such that the bottom end 26*b* is disposed in a downward direction D relative to the top end 26*a* along the second axis B. The downward direction D extends in the opposite direction to an upward direction U along axis B. Main spout 26 may be disposed relatively close to a front portion of sidewall 50 such that a distance SD measured between main center MC and the front portion of the sidewall is relatively small. For example, distance SD may be 1.7 inches (4.3 cm), or approximately 1.7 inches (4.3 cm). The main spout 26 has an outer surface that defines an attachment mechanism for a main cap 60. In some embodiments, the attachment mechanism on the main spout 26 may be threads that mate with threads on an internal surface 62 of the main cap 60. The main spout may also include an annular ring 27 disposed at its bottom end 26*b* having a ratcheted surface that is used to break a security seal from the main cap 60 when the main cap 60 is first removed by twisting from the main spout 26.

The top portion 20 also includes beveled shoulders 35 that extend upward and away from the bottom end 26*b* of the main spout relative to axis B. A front surface portion 30 having a slanted face 32 that extends in the downward direction and in a forward direction F is proximate to beveled shoulders 35 such that the bottom end 26*b* of the main spout is partially encircled by the beveled shoulders 35 and the front surface portion 30. The forward direction F is defined by a line L that extends from the first axis A to the second axis B, perpendicular to the first axis A and second axis B. A rearward direction R extends opposite to the forward direction F along line L. The front surface portion 30 includes a lip 34 that extends radially from the second axis B away from the slanted face 32 in the forward direction F. Lip 34 has a front surface 34*a* that protrudes from slanted face 32 parallel or approximately parallel to second axis B.

Figure 5A:
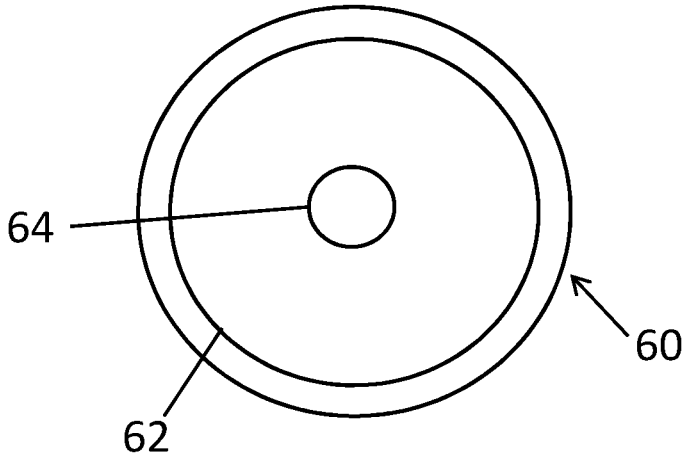
FIGS. 5A and 5B are a bottom plan view and a side elevation view of a cap for the dual handle container shown in FIGS. 1-4.
Figure 5B:
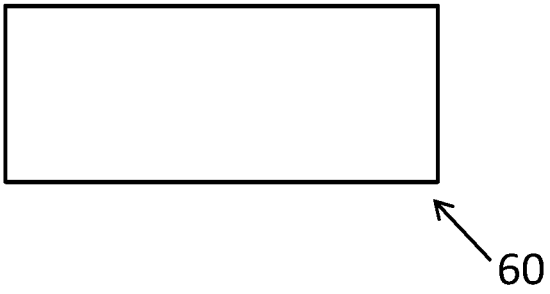

Front surface 34*a* is configured to extend at approximately the same radius r (shown in FIG. 2) as the main cap 60 (shown in FIGS. 5A and 5B) configured to be secured to main spout 26. In this way, front surface 34*a* protects the main cap 60 and minimizes the extent to which the cap hangs over the side of the container unprotected. Without the protection provided by the lip 34, the main cap 60 could be damaged and the bottom edge of the main cap 60 could be pulled away from main spout 26, upward relative to axis B during transportation. Additionally, by having lip 34 extend radially, the inner surface of the lip, along with the inner surface of the beveled shoulders 35 provide for a funnel-like structure that enables enhanced emptying of the container 10 relative to prior art structures. Main cap 60 may include a vent feature 64.

Figure 2:
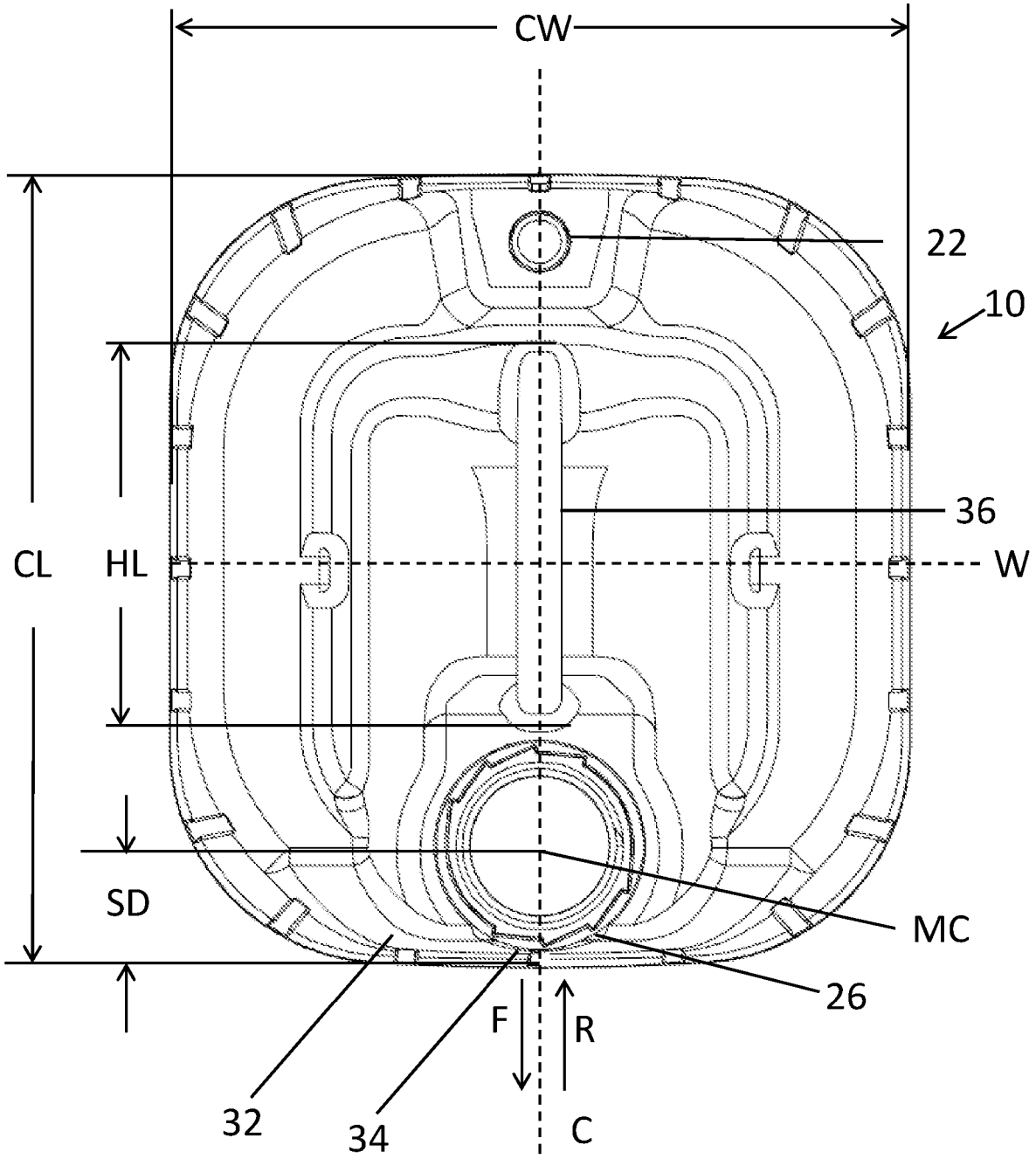
FIG. 2 is a top plan view of the dual handle container shown in FIG. 1.

The top portion 20 has an integrated handle 36 that is elongate along the line L that extends between the first axis A and the second axis B. With reference to FIG. 2, the top portion 20 defines a maximum container length CL along the line L. The handle 36 defines a maximum handle length HL along the line L. As shown in FIG. 2, the maximum container length CL is approximately twice the maximum handle length HL. The top portion 20 further defines a maximum container width CW along a line W that is perpendicular to line L. Maximum container width CW is equal to, or approximately equal to maximum container length CL. For example, container 10 may have a maximum container length CL of 11 inches (28 cm), or approximately 11 inches (28 cm) and a maximum container width CW of 10.25 inches (26 cm), or approximately 10.25 inches (26 cm). As noted above, container 10 may have a square, or substantially square configuration to provide for maximum usage of available space on a square shipping pallet. Maximum container length CL may be equal to, or substantially equal to maximum container width CW.

The top portion 20 also defines a top handle recess 37 around the integrated handle 36 and includes a recess base 33 directly below the integrated handle. The top handle recess 37 is configured to fit a gloved hand of a user. Specifically, relative to prior art configurations, handle 36 has an inner surface 36*x* that defines a longer inner handle length IHL, as measured between a forward-most point 36*a* of the handle inner surface 36*x* and a rearward-most point 36*b* of the handle inner surface 36*x*. For example, inner handle length IHL may be 3.5 inches (8.9 cm), or approximately 3.5 inches (8.9 cm), such that the inner handle length IHL is 32% or approximately or at least 32% of the maximum container length CL. Additionally, relative to prior art configurations, handle 36 and handle recess 37 defines a greater handle clearance distance HCD as measured between an upper-most point of inner surface 36*x* of the handle 36 and the recess base 33 along a line that is parallel to axis B is greater so as to provide adequate space for the relatively larger size of the user's hand when covered with safety equipment including gloves. For example, the handle clearance distance HCD may be 1.5 inches (3.8 cm), or approximately 1.5 inches (3.8 cm). In this example, if the overall maximum container height CH is 14.9 inches (37.8 inches), or approximately 14.9 inches (37.8 cm), the handle clearance distance HCD is 10%, or approximately or at least 10% of the container height CH. Moreover, in order to provide for an increased handle clearance distance HCD, recess base 33 may be disposed below main spout bottom end 26*b*.

The top portion 20 also includes structural recesses 39 that enhance the structural integrity of the container 10 and also reduce the material needed to form the container 10. Recesses 39 may also function to enhance gripping of the container by the gloved user.

Figure 3:
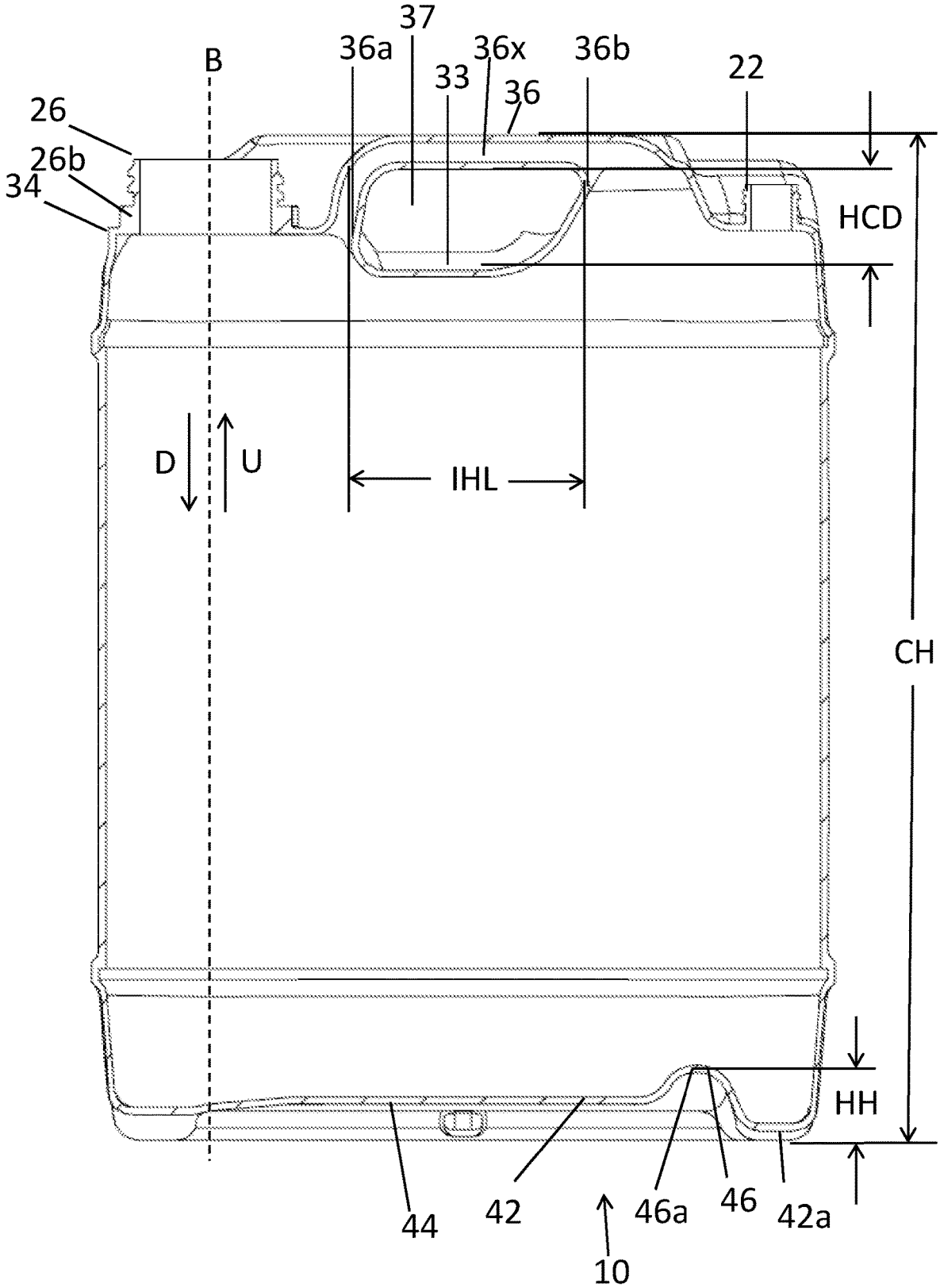
FIG. 3 is a cross sectional view of the dual handle container shown in FIGS. 1 and 2 taken along line 3-3.

With reference to FIG. 3, the base portion 40 has interior surface 42 and an exterior surface 44. The interior surface 42 is opposite the exterior surface 44. The interior surface 42 defines a series of lowest points 42*a* relative to the downward direction D, each of the series of lowest points 42*a* may be contiguous with each other such that the interior surface 42 defines a single region having the lowest points 42*a* that is uninterrupted by regions of the interior surface 42 that do not have the lowest points. Alternatively, the series of lowest points 42*a* may be contiguous with each other such that the interior surface 42 defines multiple regions having the lowest points 42*a*, such as two regions having lowest points. For example, the two regions may be separated by regions of the interior surface 42 that do not have the lowest points. As shown in FIG. 3, the base portion 40 may have varying thicknesses such that lowest points of the exterior surface 44 may not correspond to lowest points 42*a* of the interior surface. Having the series of lowest points 42*a* are entirely contiguous with each other, or separated into only two regions enables a user to drill a single hole in the base portion at the location of the series of lowest points 42*a* in order to fully drain the contents of the container 10 through the drilled hole (not shown). Container configurations that are known in the art have multiple lowest point areas separated from each other by raised areas. Such know configurations require users to drill multiple holes at the discrete low point areas in order to fully drain the container. A single contiguous area or only two contiguous areas of lowest points provides minimizes the need for these multiple holes.

Figure 4:
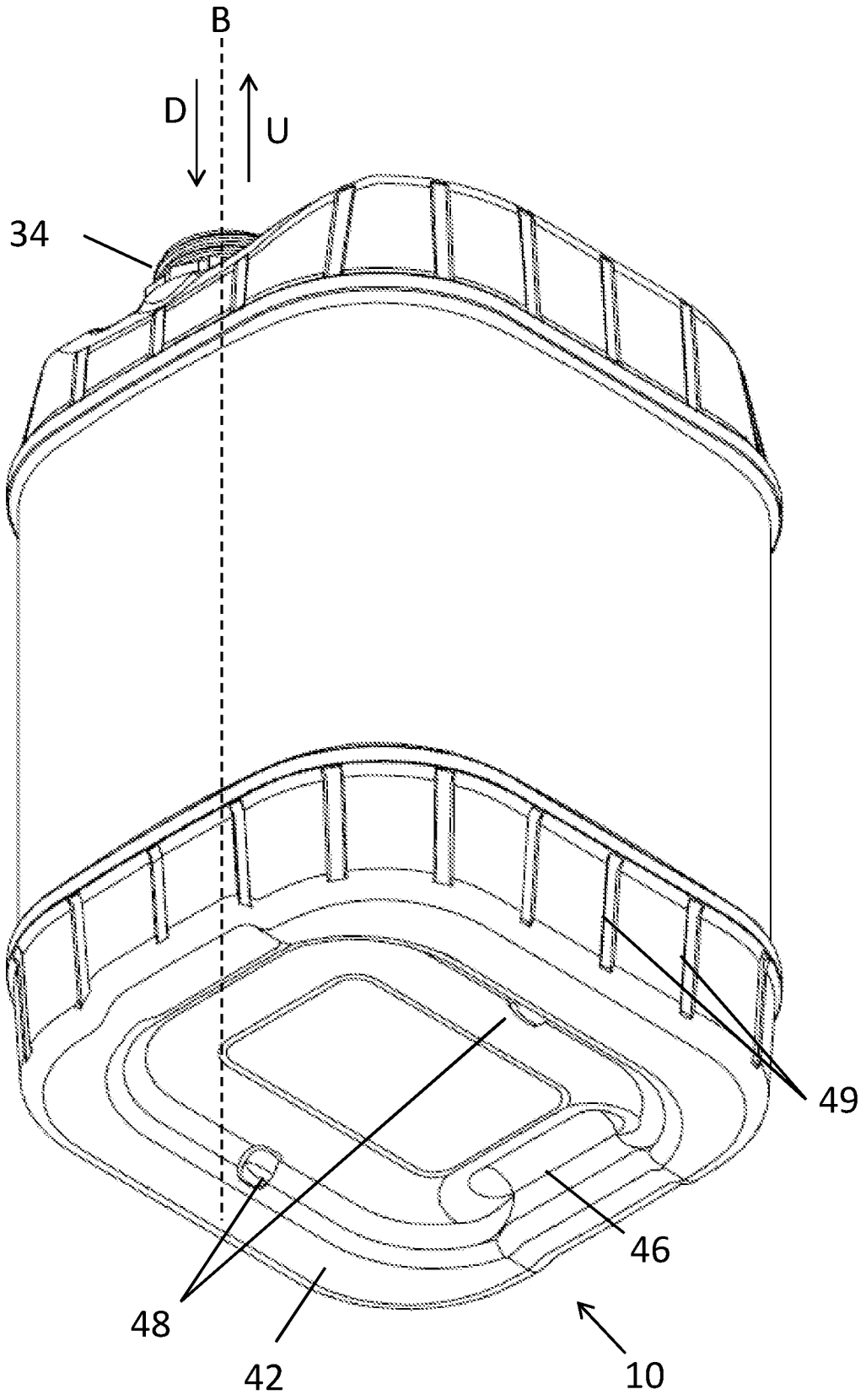
FIG. 4 is a bottom perspective view of the dual handle container shown in FIGS. 1-3

With reference to FIG. 4, exterior surface 44 defines a handle recess 46 and structural recesses 49. Handle recess 46 provides for an additional gripping structure for the user to grip in conjunction with handle 36 when lifting the container 10 and pouring the contents of container 10. Handle recess 46 may define a maximum height RH as measured from the bottom of container 10 to an uppermost point 46*a* of handle recess 46 along a line that extends parallel to axis B. Maximum height RH may be 1 inch (2.5 cm), or approximately 1 inch (2.5 cm). For example, if the overall maximum container height CH is 14.9 inches (37.8 inches), or approximately 14.9 inches (37.8 cm), the handle recess maximum height RH is 7% or approximately or at least 7% of the maximum container height CH. Like structural recesses 39, structural recesses 49 enhance the structural integrity of the container 10 and also reduce the material needed to form the container 10. Recesses 49 may also function to enhance gripping of the container by the gloved user.

Exterior surface 44 also defines stacking flanges 48. Stacking flanges 48 are configured to mate with stacking notches 38 that are defined by the top portion 20 so as to enhance the stackability of containers 10. Stacking flanges 48 and stacking notches 38 may be substantially square in shape. For example, multiple containers 10 may be stacked on one another for transportation on a pallet (not shown). Flanges 48 and notches 38 mate with each other so as to minimize lateral movement of a first container 10 relative to a second container 10 stacked above or below the first container. While the embodiment shown in FIGS. 1 and 4 depicts stacking notches 38 on the top portion 20 and stacking flanges 48 on the base portion 40, inverse configurations with stacking notches on the bottom portion and stacking flanges on the top portion are similarly effective in enhancing stackability of multiple containers, for instance, on a pallet. Moreover, while two pairs notches 38 and flanges 48 are depicted in FIGS. 1 and 4, other embodiments may have a single notch recess pair, three notch recess pairs, four notch recess pairs, five notch recess pairs, or six notch recess pairs. Other numbers of notch recess pairs may also be employed.

Sidewall 50 extends between the top portion 20 and the base portion 40. Sidewall 50 connects to the top portion 20 and the base portion 40 at annular structural ribs 52, 54, respectively. Structural ribs 52, 54 enhance the structural integrity of the container 10.

Features of the disclosure which are described above in the context of separate embodiments may be provided in combination in a single embodiment. Conversely, various features of the disclosure that are described in the context of a single embodiment may also be provided separately or in any subcombination.

Changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the claims.

What is claimed:

1. A dual handle plastic container (10) configured to store and/or transport liquid, the container comprising:

a monolithic body including a top portion (20), a base portion (40), and a sidewall (50) extending between the top portion (20) and the base portion (40);

the top portion (20) having:

(i) a vent spout (22) that defines a circular vent recess (24) having a vent center, the vent spout (22) extending longitudinally along a first axis that extends through the vent center;

(ii) a main spout (26) that defines a circular main recess (28) having a main center, the main spout (26) extending longitudinally along a second axis that extends through the main center from a top end (26*a*) of the main spout (26) to a bottom end (26*b*) of the main spout (26), the top end (26*a*) being opposite the bottom end (26*b*) along the second axis such that the bottom end (26*b*) is disposed in a downward direction relative to the top end (26*a*) along the second axis;

(iii) an integrated first handle (36) that is elongate along the line that extends in a lateral direction between the first axis and the second axis, the top portion defining a maximum container length along the line, and the handle (36) defining a maximum handle length along the line, the maximum container length being approximately twice the maximum handle length; and (iv) two projections that are elongated in the lateral direction and are respectively spaced apart from opposing lateral sides of the integrated first handle (36), wherein the projections define a topmost surface of the container (10), and wherein the first handle (36), the vent spout (22) and the main spout (26) do not extend longitudinally to an elevation above the projections of the top portion (20); and the base portion 40 having an interior surface (42) and an exterior surface (44), the interior surface (42) being opposite the exterior surface (44), the exterior surface of base portion (44) defining a second handle that is a recess (46), wherein the exterior surface (44) of the base portion (40) has a concavity that is configured to receive the two projections of the top portion (20) of a mating container in a stacked configuration, wherein the concavity comprises a portion of the second handle.

2. The plastic container (10) of claim 1 having a maximum container height, wherein the top portion (20) defines a top handle recess (37), the top handle recess (37) being partially defined by an inner handle length measured between a forward-most point (36*a*) of a handle inner surface (36*x*) and a rearward-most point (36*b*) of the handle inner surface (36*x*), the inner handle length being at least 32% of the maximum container length; and the top handle recess (37) being further partially defined by a handle clearance distance measured along a line that is parallel to the second axis between an uppermost point of the handle inner surface (36*x*) and a recess base (33) disposed directly below the handle inner surface (36*x*), the handle clearance distance being at least 10% of the maximum container height.

3. A dual handle plastic container (10) configured to store and/or transport liquid, the container comprising:

a monolithic body including a top portion (20), a base portion (40), and a sidewall (50) extending between the top portion (20) and the base portion (40);

the top portion (20) having:

(i) a vent spout (22) that defines a circular vent recess (24) having a vent center, the vent spout (22) extending longitudinally along a first axis, the first axis extending through the vent center;

(ii) a main spout (26) that defines a circular main recess (28) having a main center, the main spout (26) extending longitudinally along a second axis, the second axis extending through the main center, the main spout (26) having a top end (26*a*) and a bottom end (26*b*), the top end (26*a*) being opposite the bottom end (26*b*) along the second axis such that the bottom end (26*b*) is disposed in a downward direction relative to the top end (26*a*) along the second axis;

(iii) an integrated first handle (36) that is elongate along the line that extends in a lateral direction between the first axis and the second axis; and (iv) two projections that are elongated in the lateral direction and are respectively spaced apart from opposing lateral sides of the integrated first handle (36), wherein the projections define a topmost surface of the container (10), and wherein the first handle (36), the vent spout (22) and the main spout (26) do not extend longitudinally to an elevation above the projections of the top portion (20), and the base portion 40 having an interior surface (42) and an exterior surface (44), the interior surface (42) being opposite the exterior surface (44), and the exterior surface (44) of the base portion (40) defining a second handle which is a recess (46), wherein the exterior surface (44) of the base portion (40) has a concavity that is configured to receive the two projections of the top portion (20) of a mating container in a stacked configuration, wherein the concavity comprises a portion of the second handle.

4. The plastic container (10) of claim 3, wherein the top portion defines a maximum container length along the line, and the handle (36) defines a maximum handle length along the line, the maximum container length being approximately twice the maximum handle length.

5. The plastic container (10) of claim 3, wherein the interior surface (42) defining a series of lowest points (42*a*) relative to the downward direction, each of the series of lowest points (42*a*) being contiguous with each other.

6. The plastic container (10) of claim 3 having a maximum container height, wherein the top portion (20) defines a top handle recess, the top handle recess (37) being partially defined by an inner handle length measured between a forward-most point (36*a*) of a handle inner surface (36*x*) and a rearward-most point (36*b*) of the handle inner surface (36*x*), the inner handle length being at least 32% of the maximum container length; and the top handle recess (37) being further partially defined by a handle clearance distance measured along a line that is parallel to the second axis between an uppermost point of the handle inner surface (36*x*) and a recess base (33) disposed directly below the handle inner surface (36*x*), the handle clearance distance being at least 10% of the maximum container height.

7. A stackable dual handle plastic container (10) configured to store and/or transport liquid, the container comprising:

a monolithic body including a top portion (20), a base portion (40), and a sidewall (50) that extends between the top portion (20) and the base portion (40);

the top portion (20) having:

(i) a vent spout (22) that defines a circular vent recess (24) having a vent center, the vent spout (22) extending longitudinally along a first axis, the first axis extending through the vent center;

(ii) a main spout (26) that defines a circular main recess (28) having a main center, the main spout (26) extending longitudinally along a second axis, the second axis extending through the main center, the main spout (26) having a top end (26*a*) and a bottom end (26*b*), the top end (26*a*) being opposite the bottom end (26*b*) along the second axis such that the bottom end (26*b*) is disposed in a downward direction relative to the top end (26*a*) along the second axis;

(iii) an integrated first handle (36) that is elongate along the line that extends in a lateral direction between the first axis and the second axis, the top panel defining a maximum container length along the line, and the handle (36) defining a maximum handle length along the line, the maximum container length being approximately twice the maximum handle length; and (iv) two projections that are elongated in the lateral direction and are respectively spaced apart from opposing lateral sides of the integrated first handle (36), wherein the projections define a topmost surface of the container (10), and wherein the first handle (36), the vent spout (22) and the main spout (26) do not extend longitudinally to an elevation above the projections of the top portion (20), and the base portion 40 having an interior surface (42) and an exterior surface (44), the interior surface (42) being opposite the exterior surface (44), and the exterior surface (44) of base portion 40 defining a second handle which is a recess (46); and stacking flanges 48 configured to mate with stacking notches whereby the dual handle plastic container is stackable with another dual handle plastic container in a stacked configuration, wherein one of the stacking flanges (48) and the stacking notches is defined each projection of the top portion (20).

8. The plastic container (10) of claim 7, wherein the top portion (20) further comprises a front surface portion (30) having a slanted face (32) that extends in the downward direction and in a forward direction, the forward direction being defined by a line that extends from the first axis to the second axis, perpendicular to the first axis and second axis, the front surface portion (30) further including a lip (34) that extends radially from the second axis away from the slanted face (32) in the forward direction.

9. The plastic container (10) of claim 7, wherein the interior surface (42) defines a series of lowest points (42*a*) relative to the downward direction, each of the series of lowest points (42*a*) being contiguous with each other.

10. The plastic container (10) of claim 7 having a maximum container height, wherein the top portion (20) defines a top handle recess (37), the top handle recess (37) being partially defined by an inner handle length measured between a forward-most point (36*a*) of a handle inner surface (36*x*) and a rearward-most point (36*b*) of the handle inner surface (36*x*), the inner handle length being at least 32% of the maximum container length; and the top handle recess (37) being further partially defined by a handle clearance distance measured along a line that is parallel to the second axis between an uppermost point of the handle inner surface (36*x*) and a recess base (33) disposed directly below the handle inner surface (36*x*), the handle clearance distance being at least 10% of the maximum container height.

11. An organic peroxide packaged in the containers of claim 7.

12. The organic peroxide of claim 11, wherein the organic peroxide is in neat form or includes an organic diluent.

13. The plastic container (10) of claim 7, wherein the integrated first handle (36) and the second handle recess (46) together comprise the dual handles of the container.

14. The plastic container (10) of claim 7 further comprising a cap (60) having a vent (64), the cap (60) configured to cover the main spout (26).

15. The plastic container (10) of claim 7 wherein the length of the container is approximately equal to a width of the container, the width being defined perpendicular to the length.

16. A method for storing and/or transporting liquid in a dual handle plastic container (10), the plastic container (10) including a monolithic body having a top portion (20), a base portion (40), and a sidewall (50) that extends between the top portion (20) and the base portion (40), the top portion (20) having fi) a vent spout (22) that defines a circular vent recess (24) having a vent center, the vent spout (22) extending longitudinally along a first axis that extends through the vent center; (ii) a main spout (26) that defines a circular main recess (28) having a main center, the main spout (26) extending longitudinally along a second axis that extends through the main center from a top end (26*a*) of the main spout (26) to a bottom end (26*b*) of the main spout (26), the top end (26*a*) being opposite the bottom end (26*b*) along the second axis such that the bottom end (26*b*) is disposed in a downward direction relative to the top end (26*a*) along the second axis; (iii) an integrated first handle (36) that is elongate along the line that extends in a lateral direction between the first axis and the second axis, and (iv) two projections that are elongated in the lateral direction and are respectively spaced apart from opposing lateral sides of the integrated first handle (36), wherein the projections define a topmost surface of the container (10), and wherein the first handle (36), the vent spout (22) and the main spout (26) do not extend longitudinally to an elevation above the projections of the top portion (20); the base portion 40 having an interior surface (42) and an exterior surface (44), the interior surface (42) being opposite the exterior surface (44), the exterior surface (44) of base portion (40) defining a second handle in recess form (46), wherein the exterior surface (44) of the base portion (40) has a concavity that is configured to receive the two projections of the top portion (20) of a mating container in a stacked configuration, wherein the concavity comprises a portion of the second handle, the method comprising:

positioning the plastic container (10);

filling the plastic container (10) with liquid;

sealing the plastic container (10); and storing or transporting the liquid.

17. The method of claim 16, wherein the liquid is an organic peroxide.

18. The method of claim 16, wherein the organic peroxide is in neat form or includes an organic diluent.

19. The dual handle plastic container of claim 3 comprising stacking flanges 48 configured to mate with stacking notches whereby the dual handle plastic container is stackable, wherein one of the stacking flanges and the stacking notches are defined on each of the projections of the top portion (20).

20. The dual handle plastic container of claim 1, further comprising stacking flanges (48) configured to mate with stacking notches of the mating container in the stacked configuration, wherein one of the stacking flanges (48) and the stacking notches is defined on each of the projections of the top portion (20).

* * * * *